US005263878A

United States Patent [19]

Lai

[11] Patent Number: 5,263,878

[45] Date of Patent: Nov. 23, 1993

[54] SPEEDY CONNECTING SOCKET

[76] Inventor: Chen-Kun Lai, No. 6, Chuan-Kuang Road, Tai-Tung Shih, Tai-Tung Hsien, Taiwan

[21] Appl. No.: 53,225

[22] Filed: Apr. 28, 1993

[51] Int. Cl.[5] ..... H01R 17/00

[52] U.S. Cl. ..... 439/656; 439/441

[58] Field of Search ..... 439/788, 794, 656, 658, 439/438–441

[56] References Cited

U.S. PATENT DOCUMENTS

| | | | |
|---|---|---|---|
| 1,756,940 | 5/1930 | Diener | 439/656 |
| 2,869,165 | 1/1959 | Pistey | 439/656 |
| 4,397,518 | 8/1983 | Tsai | 439/656 |
| 4,886,472 | 12/1989 | Tsai | 439/656 |

*Primary Examiner*—David L. Pirlot

*Attorney, Agent, or Firm*—Morton J. Rosenberg; David I. Klein

[57] ABSTRACT

A speedy connecting socket has socket body to contain two press keys deposited vertically one on the other in a through opening, a coil spring deposited between the two keys to enable the keys to be pressed elastically a little in the opening to let naked end portions of two leads insert in a widened gap between the keys and inner walls of the socket body in case of the keys pressed inward. And then, the widened gap is capable of being narrowed to pinch tightly therein the end portions of the leads if the keys are released.

2 Claims, 3 Drawing Sheets

SPEEDY CONNECTING SOCKET

BACKGROUND OF THE INVENTION

In connecting two pairs of two leads, generally end portions of the leads are removed of their outer covering material to expose copper wires of single or multicore, and they are twisted around each other and then wrapped around with insulating tape to prevent electricity from leaking out or a person from touching to be electrically shocked.

However, this common way of connecting leads has several drawbacks.

1. Manually twisted connecting portions are easily separated from each other.

2. Insulating tape covering a connected portion becomes hard to break or looses adhesiveness for a certain period of use so that naked wires may be exposed to cause danger of shortcircuit.

3. Manual connecting takes time and a connected portion looks bad.

SUMMARY OF THE INVENTION

This invention has been devised to offer a speedy connecting socket, which is used to connect two pairs of two leads speedily to lengthen a circuit.

The speedy connecting socket in the present invention includes a socket body to contain two press keys deposited vertically in a through opening of the socket body. Each press key can be pressed inward elastically by means of a coil spring deposited between the two keys so that two gaps between each key and two plate conductors provided between the press key and the socket side walls can be widened to let naked end portions of two leads to be insertd in the gaps, and then the key is released to narrow the gap to pinch tightly the naked end portions of the leads in connecting two pairs of two leads very quickly.

BRIEF DESCRIPTION OF DRAWINGS

The invention will be better understood by reference to the accompanying drawings, wherein.

DESCRIPTION OF THE PREFERRED EMBODIMENTS

Figure 1:
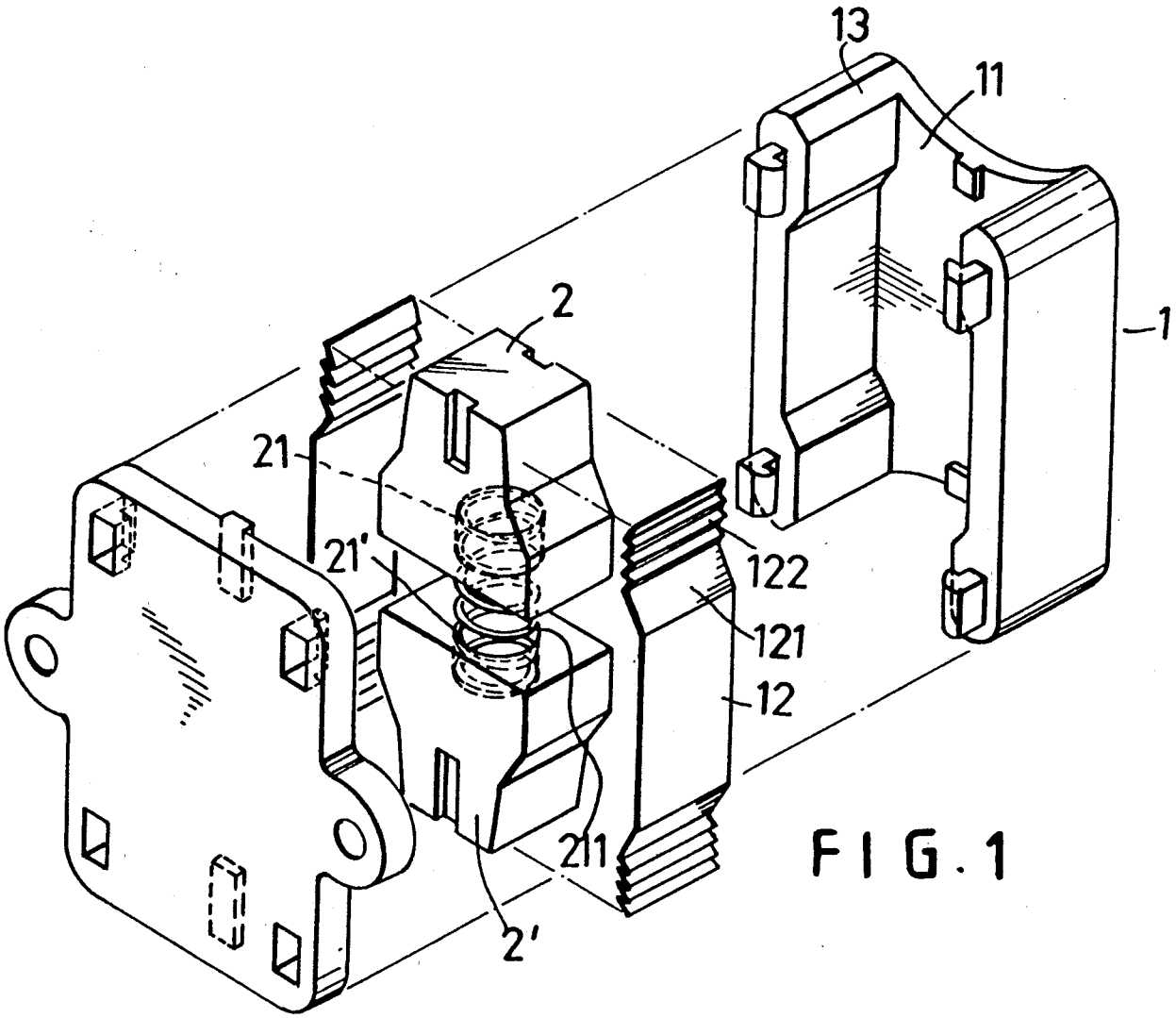
FIG. 1 is an exploded perspective view of a speedy connecting socket in the present invention.
Figure 2:
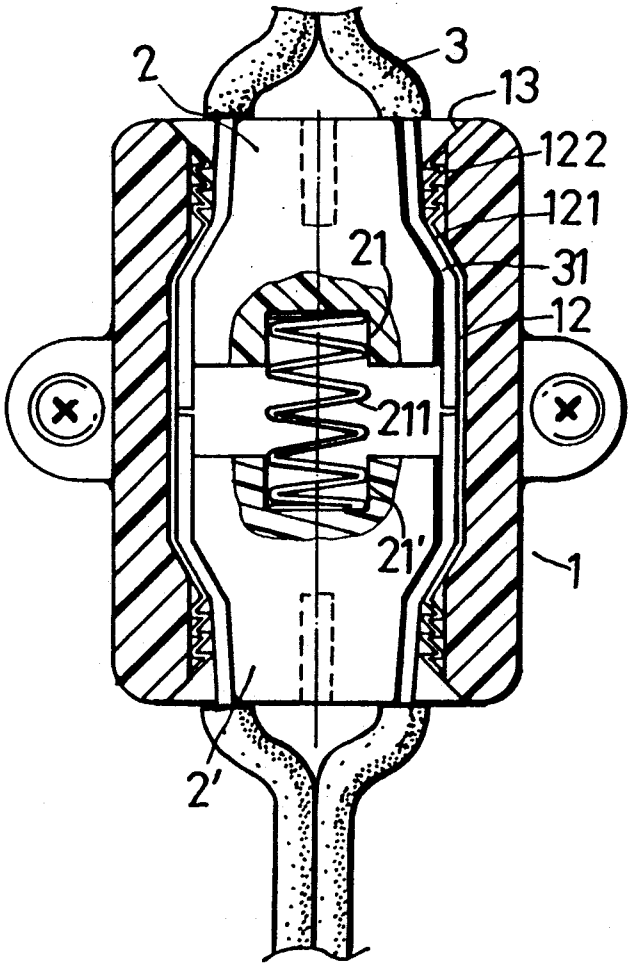
FIG. 2 is a cross-sectional view of the speedy connecting socket in the present invention.

A speedy connecting socket in the present invention, as shown in FIGS. 1, 2, includes a socket body 1 having a throuh opening 11 extending from an upper side to a lower side, two press keys 2, 2' deposited vertically one on the other in the through opening 11, two plate conductors 12, 12 respectively deposited the two press keys 2, 2' between two opposite sides of the socket body 1 as its components.

The two press keys 2, 2', an upper one 2 and a lower one 2', respectively have a round recess 21, 21' in a bottom surface or in a top surface to correspondingly face against each other for two end portions of a coil spring 211 to fit therein so that the two press keys 2, 2' can be elastically moved inward or a little. In addition, an upper portion of the upper key 2 and a lowr portion of the lower key 2' have a narrower width than a lower portion of the upper key 2 and an upper portion of the lower key 2' and the socket body 1 has upper portions and lower portions of two opposite sides to coordinate the narrower upper end and the lower end of the two press keys 2, 2' so that the keys 2. 2' cannot drop out of the socket 1 once they are assembled together.

The two plate conductors 12, 12 respectively have a plurality of horizontal teeth 122 on an upper end and a little bent function face 121 below the teeth 122.

The socket body 1 has a sloped face 13 on a top face and a bottom face of the two opposite sides facing the two keys 2, 2', enabling a lead 31 of a single or multicore wire to be inserted along the sloped face 13 into the socket body 1.

Figure 3:
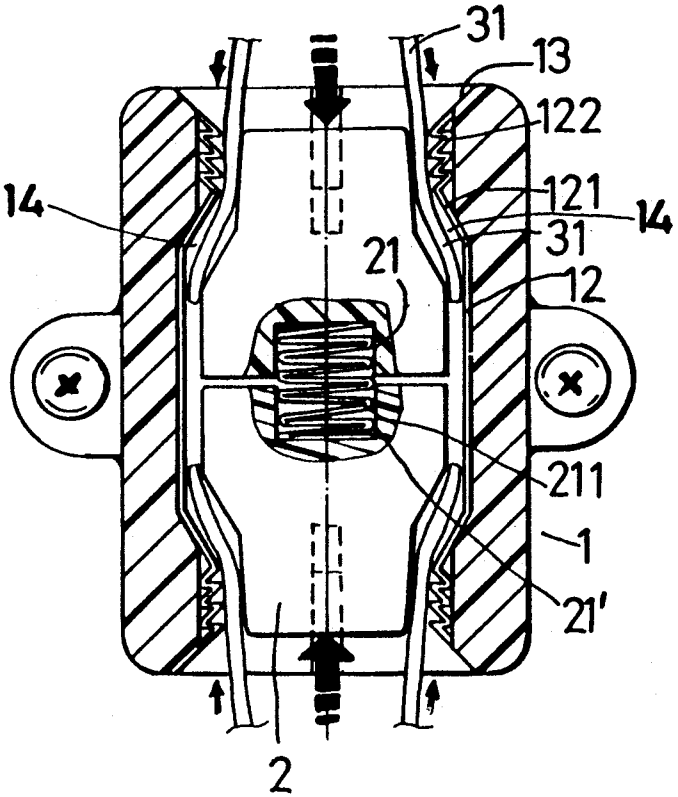
FIG. 3 is a cross-sectional view of the speedy connecting socket in the present invention connecting two pairs of two leads.

In using this socket to connect one pairs of two leads 3, 3 for lengthening a circuit, as shown in FIG. 3, first the press key 2 is pressed inward in the through opening 11 so as to compress the coil spring 21 and to widen two gaps 14, 14 between both the side surfaces of the key 2 and the function faces 121, 121 of the two plate conductors 12, 12. Then naked end portions of the pair of two leads 3, 3 are inserted along the sloped faces 13, 13 in the gaps 14, 14 and then releasing the press key 2 can let the coil spring 211 lengthen to push up the key 2 to an original position and the naked copper wire 31 of the leads 3, 3 are to be tightly pinched between the function faces 121, 121 of the conductors 12, 12, as the gaps 14, 14 becomes narrower. In addition, the teeth 122 of the conductor assist to lock the naked copper wires 31, 31 of the leads 3, 3 in place. Next, the lower press key 2' is also pressed inward to pinch the other pair of two leads 3, 3 just the same way of the upper press key 2, to finish speedy connecting of two pairs of two leads 3, 3 in lengthening the circuit.

Figure 5:
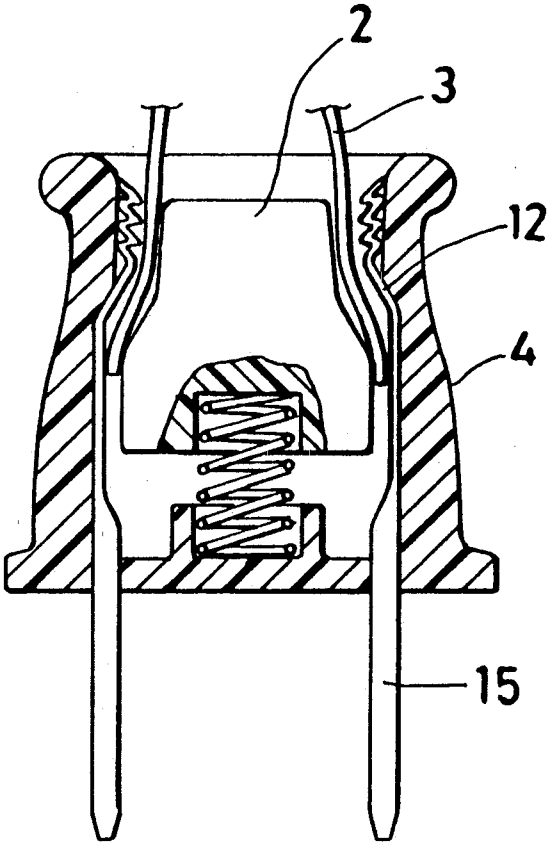
Figure 4:
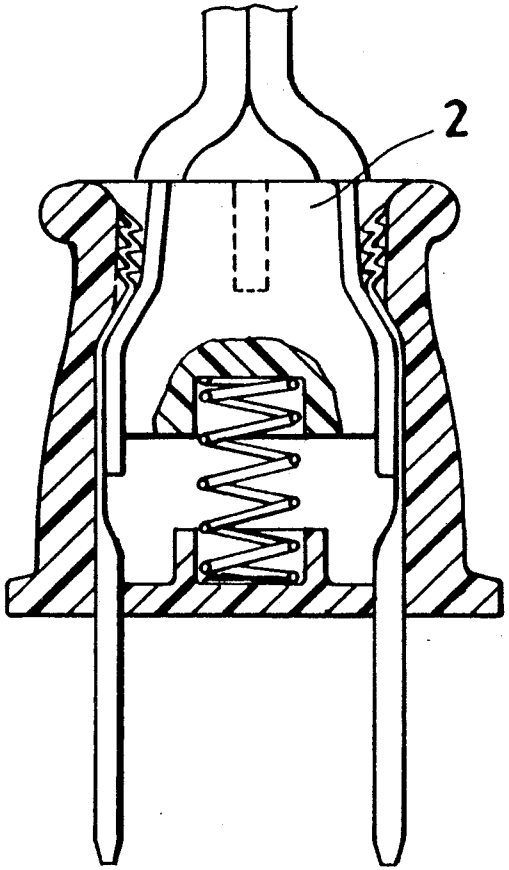
FIG. 4 is a cross-sectional view of the speedy connecting socket formed as a plug in the present invention; and, FIG. 5 is another cross-sectional view of the speedy connecting socket formed as a plug in the present invention.

FIGS. 4 and 5 show this socket body 1 can be formed as a plug body 4, and two long plate rigid conductors 15, 15 instead of two plate conductors 12, 12 are provided to extend out of the socket body 1. Then this socket becomes a plug.

While the preferred embodiments of the invention have been described above, it will be recognized and understood that various modifications may be made therein and the appended claims are intended to cover all such modificatios which may fall within the spirit and scope of the invention.

What is claimed is:

1. A speedy connecting socket comprising:

a socket body having a through opening extending from an upper side to a lower side for containing two press keys and two plate conductors, having a sloped face on an upper face and on a lower surface of two opposite sides, and a thicker upper poriton and a thicker lower portion of said two opposite sides;

said two press keys deposited vertically one on the other in said through opening of said socket body, having a round recess in a bottom surface of an upper press key and in a top surface of a lower press key, and a narrower upper portion than a lower portion of said upper press key and a narrower lower portion than an upper portion of said lower press key;

a coil spring deposited to have its upper end fitting in said round recess of said upper press key and its lower end fitting in the round recess of said lower press key, giving some elasticity to said two press keys so that said two press keys assembled in said socket body can be pressed inward a little;

said two plate conductors respectively deposited between said two opposite sides of said two press keys and two inner vertical walls of said two opposite sides of said socket body, having a toothed top end portion and a little bent function face below said toothed top end portion; and, each said press key pressed inward elastically by means of said coil spring in said through opening of said socket body to widen a gap between said function face portion of each said conductor for a naked and portion of a lead to be pushed in said gap, then said press key released to narrow said gap so that said naked end portion of said lead can be pinched therein tightly by said press key and said conductor, with said toothed portion of said conductor assisting to lock said lead stably.

2. The speedy connecting socket as claimed in claim 1, wherein two long plate conductors are used instead of said two plate conductors, extending out of said socket body, to change said speedy connecting socket into a speedy plug.

* * * * *